US012359521B2

(12) United States Patent
Strankman

(10) Patent No.: US 12,359,521 B2
(45) Date of Patent: Jul. 15, 2025

(54) REMOTE ACTUATED ROTARY WELLHEAD CONNECTION

(71) Applicant: Edge Mechanical Design Inc., Red Deer (CA)

(72) Inventor: Daine Strankman, Red Deer (CA)

( * ) Notice: Subject to any disclaimer, the term of this patent is extended or adjusted under 35 U.S.C. 154(b) by 4 days.

(21) Appl. No.: 18/235,260

(22) Filed: Aug. 17, 2023

(65) Prior Publication Data

US 2024/0060380 A1 Feb. 22, 2024

(30) Foreign Application Priority Data

Aug. 18, 2022 (CA) ..... CA 3170855

(51) Int. Cl.
*E21B 33/03* (2006.01)

(52) U.S. Cl.
CPC ..... *E21B 33/03* (2013.01)

(58) Field of Classification Search
CPC ..... E21B 33/03
USPC ..... 166/85.5
See application file for complete search history.

(56) References Cited

U.S. PATENT DOCUMENTS

| | | | | |
|---|---|---|---|---|
| 4,437,521 | A * | 3/1984 | Richardson | E21B 43/017 166/344 |
| 9,879,496 | B2 | 1/2018 | Johansen et al. | |
| 10,808,484 | B2 | 10/2020 | Goy et al. | |
| 2015/0021018 | A1* | 1/2015 | Tunget | E21B 7/061 166/305.1 |
| 2019/0292870 | A1* | 9/2019 | Goy | E21B 47/06 |

* cited by examiner

*Primary Examiner* — Matthew Troutman
*Assistant Examiner* — Patrick F Lambe
(74) *Attorney, Agent, or Firm* — Sander R. Gelsing

(57) ABSTRACT

In one aspect there is provided a remote actuated rotary wellhead connection system for connecting pressure control equipment to a wellhead. The system comprises a flange assembly connectable to the wellhead, a crossover, a nut assembly to threadably secure the crossover to the flange assembly, and a nut assembly actuator to actuate the nut assembly between a threaded, connected state and an unthreaded, disconnected state. The crossover is connectable to the pressure control equipment, and the nut assembly actuator is remotely actuatable.

20 Claims, 18 Drawing Sheets

REMOTE ACTUATED ROTARY WELLHEAD CONNECTION

FIELD OF THE INVENTION

This invention relates generally to an apparatus, system and method for connecting pressure control equipment (PCE) to a wellhead. More particularly, the invention relates to apparatus, systems and methods for making remote pressurized connections to a wellhead, without need for manual interaction at the wellhead.

BACKGROUND OF THE INVENTION

The background information discussed below is presented to better illustrate the novelty and usefulness of the present invention. This background information is not admitted prior art.

On a multi-wellhead wellsite there is often a need to move PCE, and any associated tool strings, from one wellhead to another wellhead. Conventionally such PCE connections to a wellhead are done manually, e.g., via bolted flanged connection, threaded connection, hand union or hammer union. The PCE is often heavy and, while it is being connected/disconnected to and from the wellhead, it is typically suspended above the wellhead via use of a crane. This often places wellhead operators and wellsite personnel in danger of injury, such as collision with the suspended PCE, or pinched or crushed fingers and hands when securing or removing the connection.

Remotely actuated wellhead connection systems have been developed, such as that disclosed in U.S. Pat. No. 9,879,496 to Johansen, et al. and in U.S. Pat. No. 10,808,484. However, these remotely actuated wellhead connection systems typically employ intricate mechanical cams, collets and clamps with complex geometries that require detailed machining during manufacturing. These remotely actuated wellhead connection systems are also expensive and tend to be heavy.

Therefore, what is needed is a remotely actuated wellhead connection apparatus, system and method that does not suffer from these disadvantages.

SUMMARY OF THE INVENTION

In an embodiment of the invention, there is provided a remote actuated rotary wellhead connection system for connecting pressure control equipment to a wellhead. The system comprises a flange assembly connectable to the wellhead, a crossover, a nut assembly to threadably secure the crossover to the flange assembly, and a nut assembly actuator to actuate the nut assembly between a threaded, connected state and an unthreaded, disconnected state. The crossover is connectable to the pressure control equipment, and the nut assembly actuator is remotely actuatable.

In another embodiment of the invention the nut assembly is slidably, rotatably mounted on the crossover.

BRIEF DESCRIPTION OF THE DRAWINGS

Referring to the drawings, several aspects of the present invention are illustrated by way of example, and not by way of limitation, in detail in the figures, wherein.

DEFINITION SECTION

Figure 1:
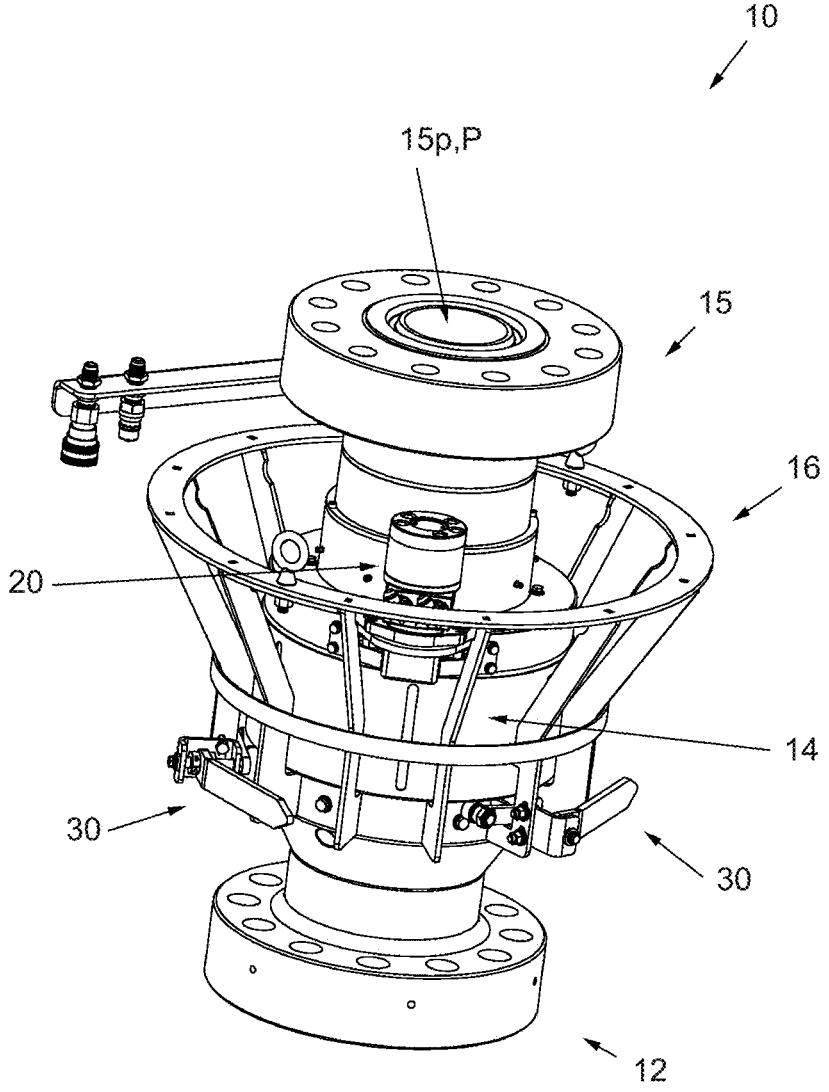
FIG. 1 is a top perspective view of a remote actuated rotary wellhead connector in accordance with a preferred embodiment of the present invention.
Figure 2:
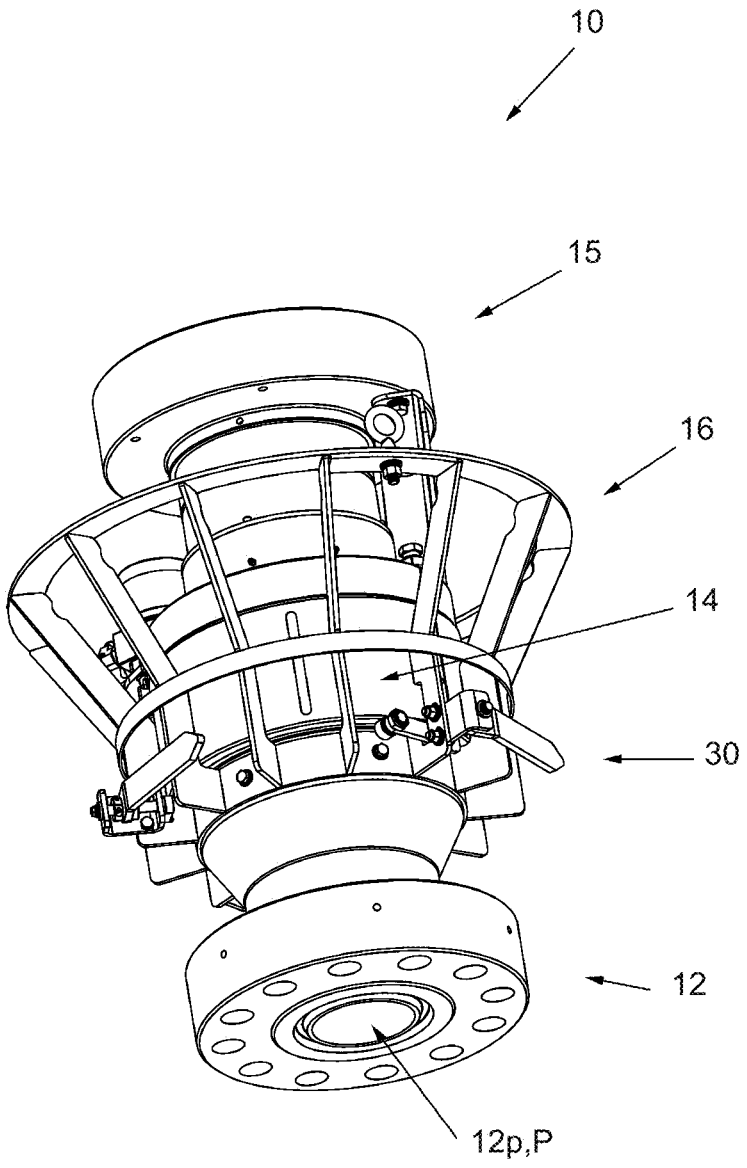
FIG. 2 is a bottom perspective view of the remote actuated rotary wellhead connection of FIG. 1.
Figure 3:
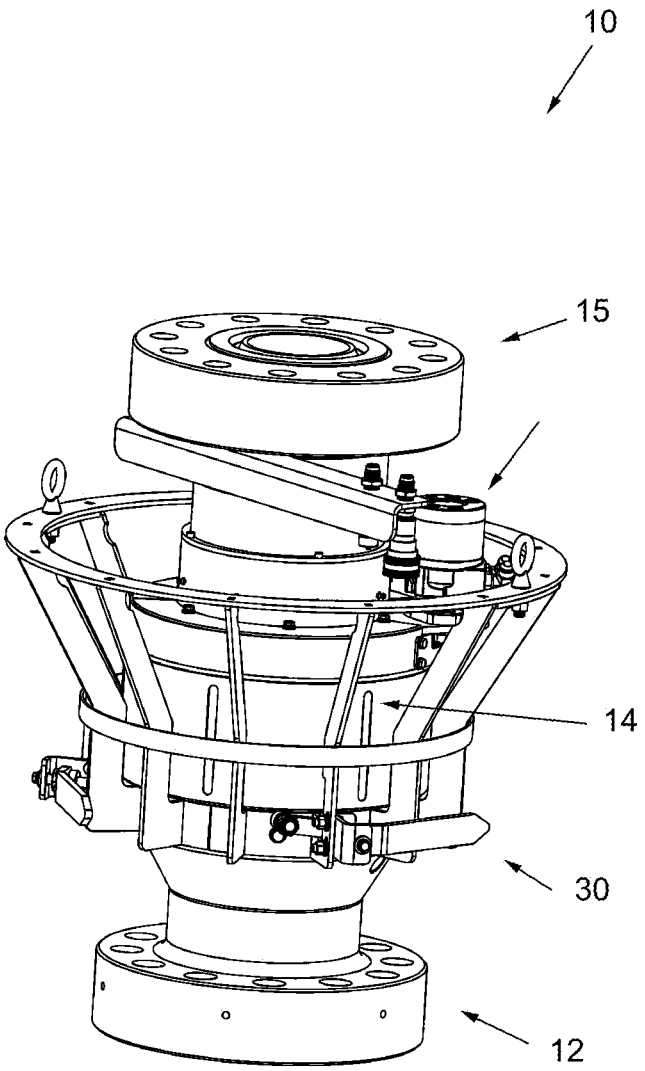
FIG. 3 is another top perspective view of the remote actuated rotary wellhead connection of FIG. 1.
Figure 4:
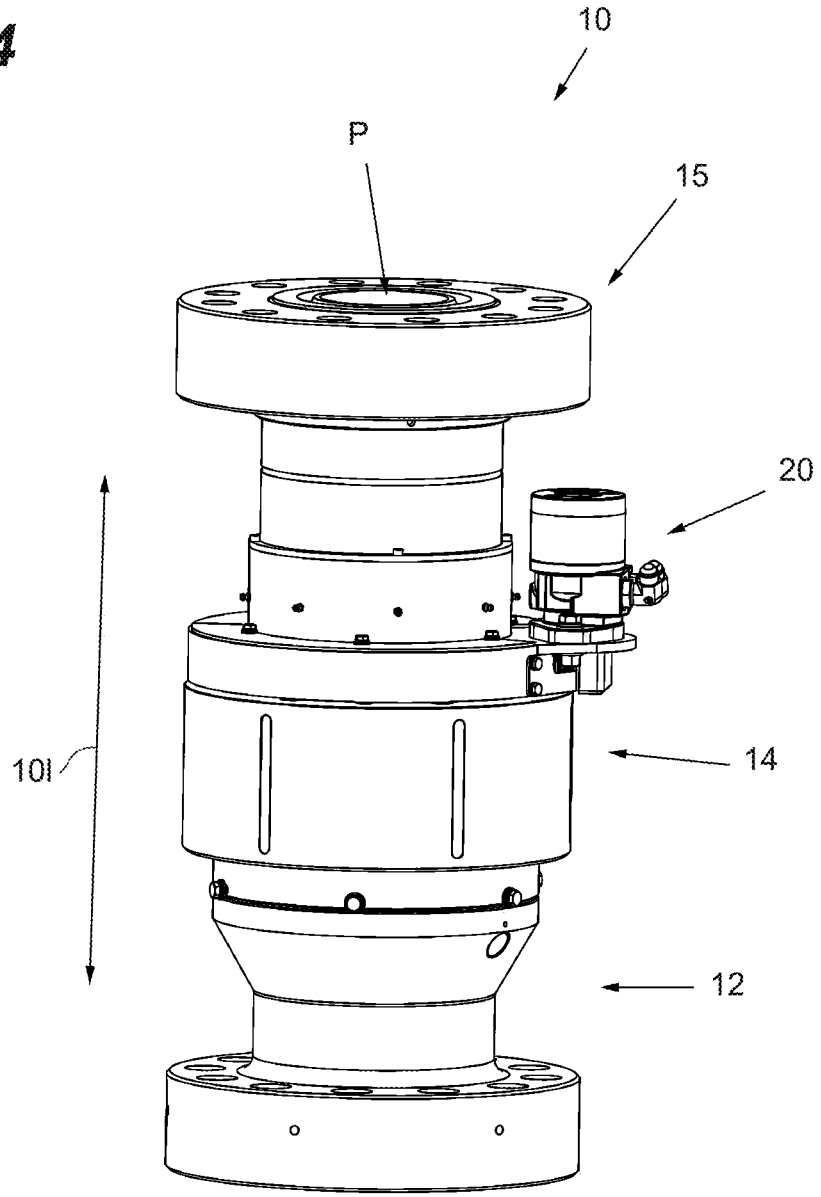
FIG. 4 is a side perspective view showing the main components of the remote actuated rotary wellhead connection of FIG. 1, and with the other components hidden.
Figure 5A:
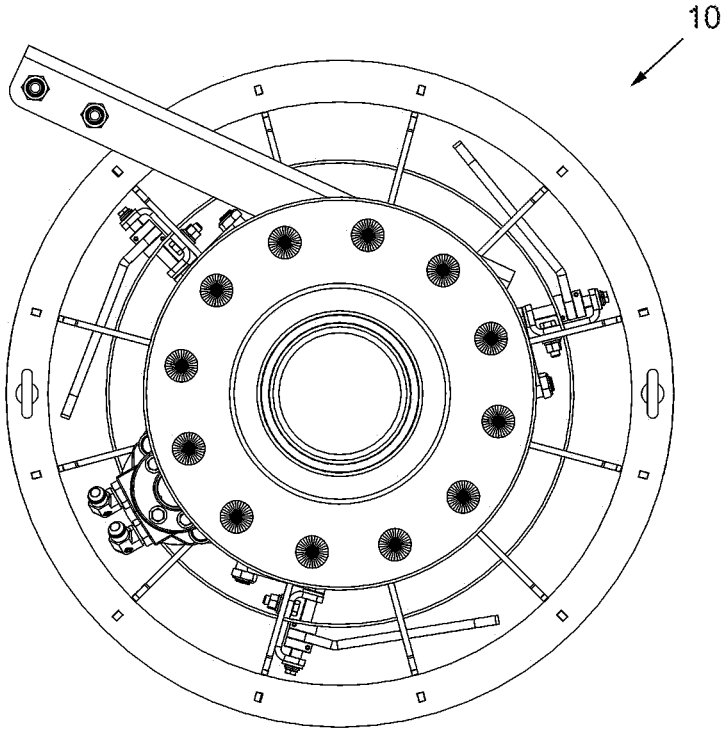
FIGS. 5*a* and 5*b* are top and bottom views respectively of the remote actuated rotary wellhead connection of FIG. 1.
Figure 5B:
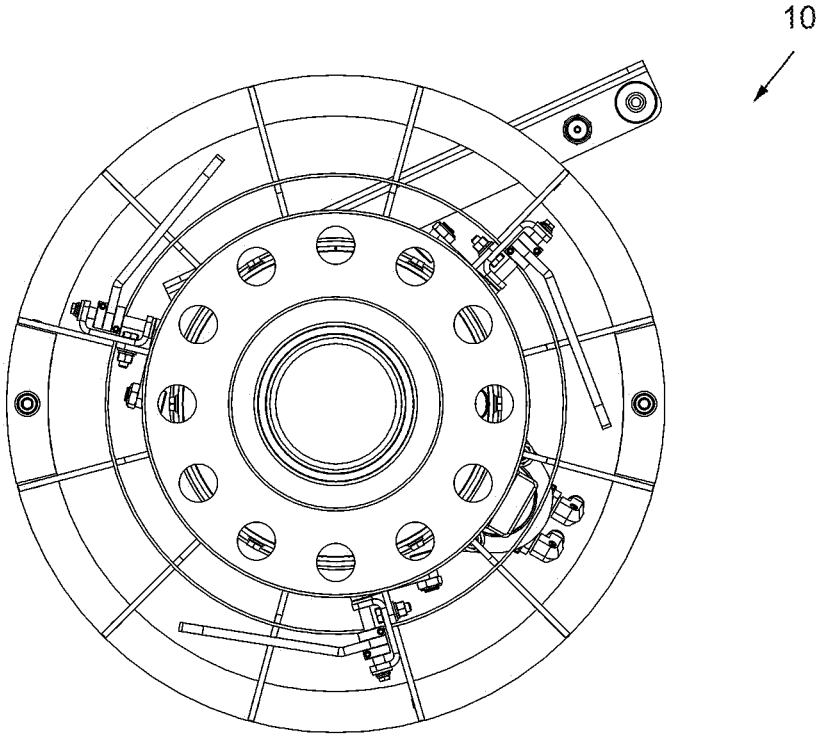

Horizontal plane, as used herein, refers to a plane that is horizontal at a given point if it is perpendicular to the gradient of the gravity field at that point, in other words, apparent gravity is what makes a plumb bob hang perpendicular to the plane at that point. In other words a horizontal plane in the plane that is perpendicular to the line that passes through the center of the Earth.

Vertical plane, as used herein, refers in astronomy, geography, geometry, and related sciences and contexts, to a direction passing by a given point if it is locally aligned with the gradient of the Earth's gravity field, i.e., with the direction of the gravitational force (per unit mass, i.e. gravitational acceleration vector) at that point.

DETAILED DESCRIPTION OF THE PREFERRED EMBODIMENTS

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

Additionally, to assist in the description of the invention, words such as top, bottom, upper, lower, above, below, front, rear, right and left are used to describe the accompanying figures. It will be appreciated, however, that the present invention can be located and positioned in a variety of desired positions and angles, and that the various components can be arranged in other suitable configurations. The terms "comprising," "comprises," "including," "includes," "having," "haves," and their grammatical equivalents are used herein to mean that other components, elements or steps are optionally present.

A first embodiment of a wellhead connection 10 of the present invention is shown in FIGS. 1-5*b* and 9*a*-12*a*. The wellhead connection 10 connects PCE (not shown) to a wellhead (also not shown). The wellhead connection 10 comprises a flange assembly 12 that is connectable to the wellhead (not shown), a nut assembly 14 to threadably secure a crossover 15 to the flange assembly 12, and a nut assembly actuator 20 to actuate the nut assembly 14 between a threaded, connected state C and an unthreaded, disconnected state D. The crossover 15 is connectable to PCE (not shown). Preferably the nut assembly 14 is slidably, rotatably mounted on the crossover 15 (much like a conventional hand union nut is mounted on a conventional crossover).

The wellhead connection 10 and its various components are preferably standard API pressure control equipment suitable to handle typical wellbore pressures, preferably with conventional ports to allow for pressure bleed offs, injection of fluid and pressure testing. The wellhead connection 10 has a bore or passage P configured to permit the passage of wellbore fluids from the wellhead to the PCE. Preferably the passage P is an axial bore running along the longitudinal axis 101 of the wellhead connection and sufficiently large to also allow passage of any tool strings associated with the PCE therethrough.

Preferably the wellhead connection 10 further comprises a guide or funnel 16 to aid in positioning the crossover 15 for subsequent securing to the flange assembly 12 via nut assembly 14. More preferably, the guide 16 has one or more openings or windows 16*w* so that an operator can view the nut assembly 14, nut assembly actuator 20 and crossover 15 therethrough as the wellhead connection 10 is actuated between the threaded, connected state C and the unthreaded, disconnected state D. Even more preferably, one or more rigid flags 30 are configured to be positioned in an "up" or "level" position when the wellhead connection 10 is in the threaded, connected state C, and in a "down" position when the wellhead connection 10 is in the unthreaded, disconnected state D.

Flange assembly 12 can be understood with reference to the embodiments shown in FIGS. 6*a*-6*e*. The flange assembly 12 is a hollow tubular member, having a flange passage 12*p* therethrough and comprising a first, lower connection 121 for connecting to a wellhead (directly or through intervening equipment) in a conventional manner. Preferably the lower connection 121 is a flanged connection. The flange assembly 12 further comprises a second, upper connection 12*u* for connecting to the crossover 15. The upper connection 12*u* of the flange assembly 12 includes a receptable 12*r* configured to receive the crossover 15 as further described below. The upper connection 12*u* also further comprises a threaded section 12*t* configured to threadably engage with, and mate to, a threaded section 14*t* on the nut assembly 14 in a conventional manner.

Figure 6A:
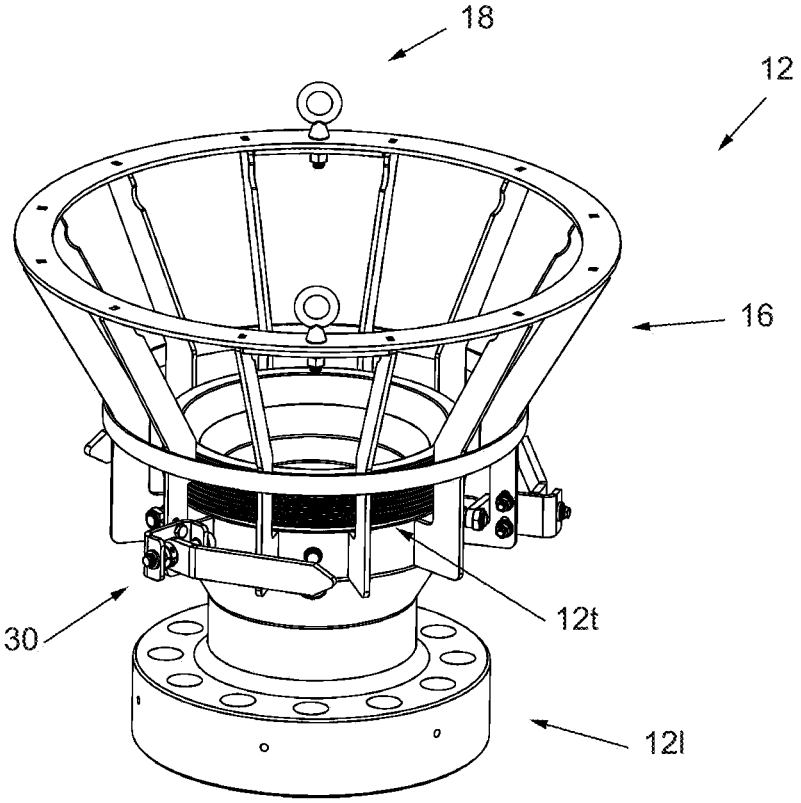
FIG. 6*a* is a perspective view of an exemplary flange assembly of a wellhead connection according to an aspect of the invention, this embodiment having a guide and a plurality of rigid flags mounted to the flange assembly.
Figure 6B:
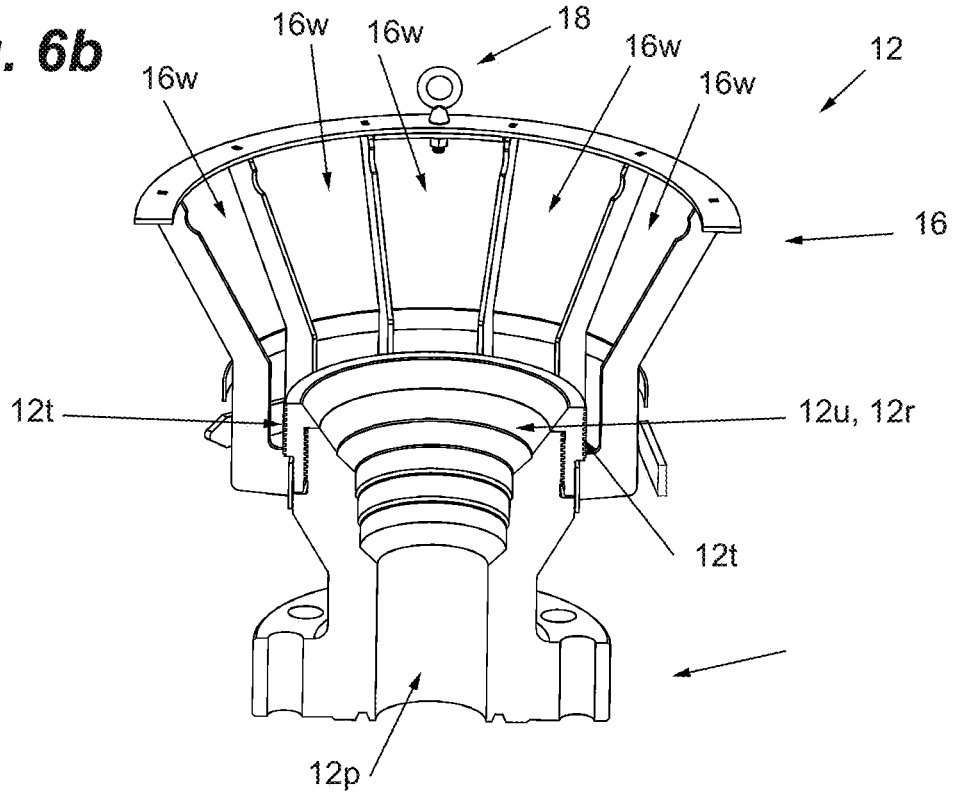
FIG. 6*b* is a sectioned view of the flange assembly of FIG. 6*a;*
Figure 6C:
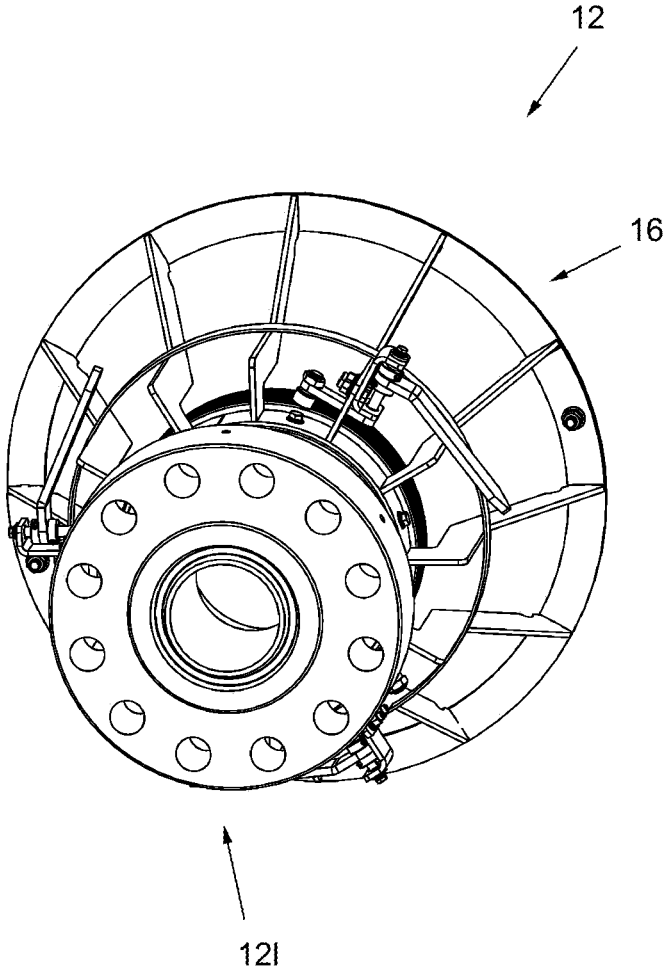
FIG. 6*c* is a bottom perspective view of the flange assembly of FIG. 6*a;*
Figure 6D:
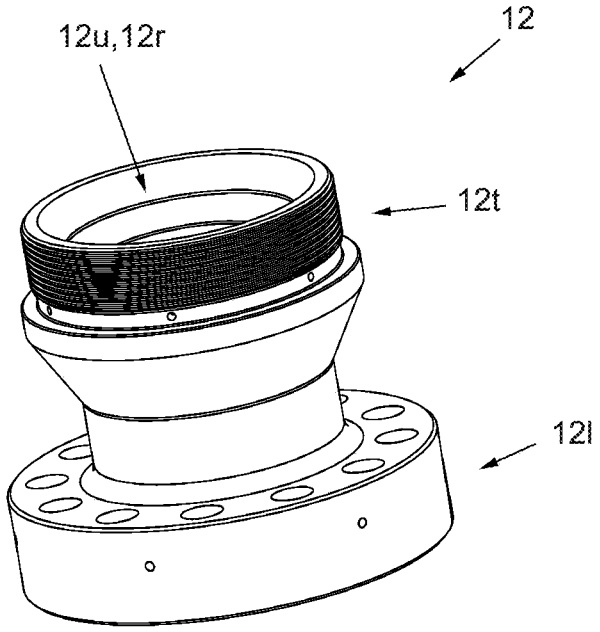
FIGS. 6*d*-6*e* are perspective views of another exemplary flange assembly of a wellhead connection according to an aspect of the invention.
Figure 6E:
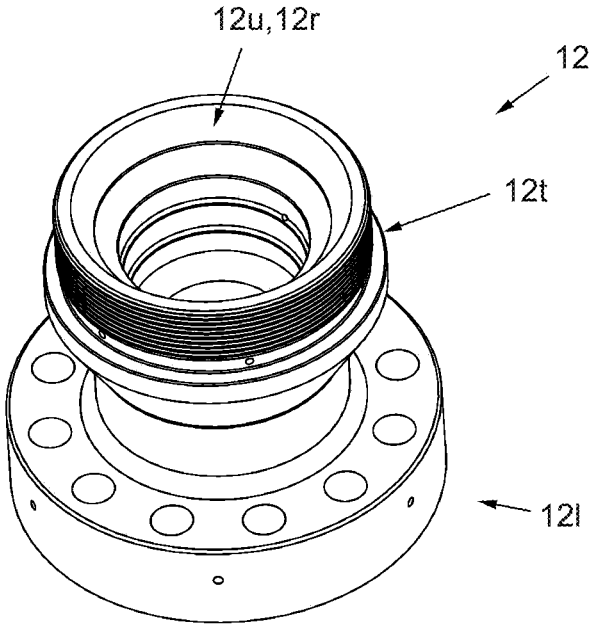

In embodiments where present, the guide 16 is preferably mounted to the upper connection 12*u* of the flange assembly 12, e.g., mounted to the outer periphery of the upper connection 12*u* as shown in FIGS. 6*a* and 6*b*. One or more flange assembly lifting lugs 18 are preferably provided on the flange assembly 12 (e.g., on the guide 16) to assist with lifting and moving the flange assembly 12, such as via a chains and a crane in a conventional manner. More preferably, the one or more lifting lugs 18 are mounted on the top of the guide 16 as shown in the figures. In embodiments where present, the one or more rigid flags 30 are preferably mounted to the guide 16 adjacent the upper connection 12*u* so that they may be engaged with, and actuated by, the nut assembly 14 when the nut assembly 14 is fully treaded to the upper end 12*u*.

Figure 7A:
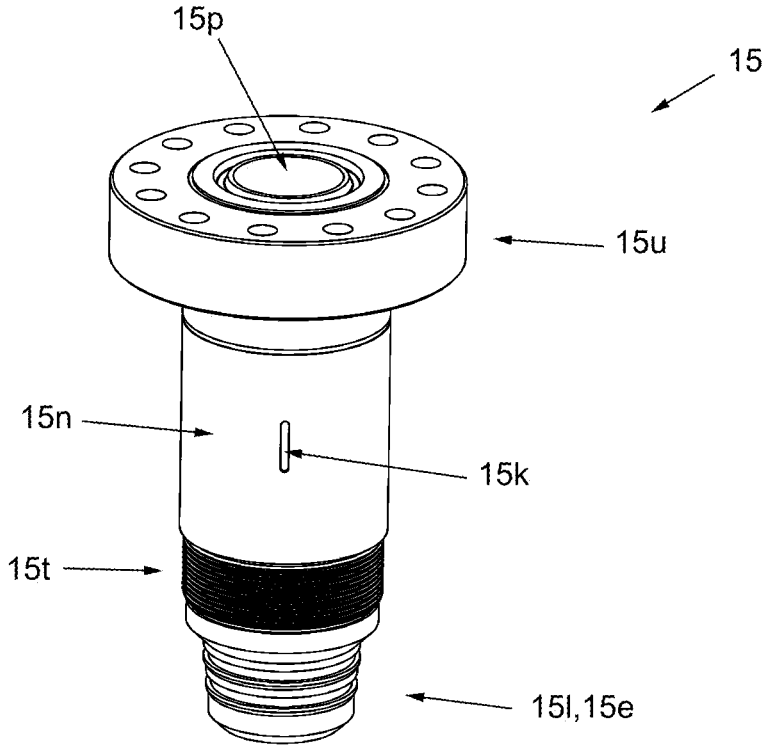
FIG. 7*a* is a perspective view of an exemplary crossover of a wellhead connection according to an aspect of the invention.
Figure 7B:
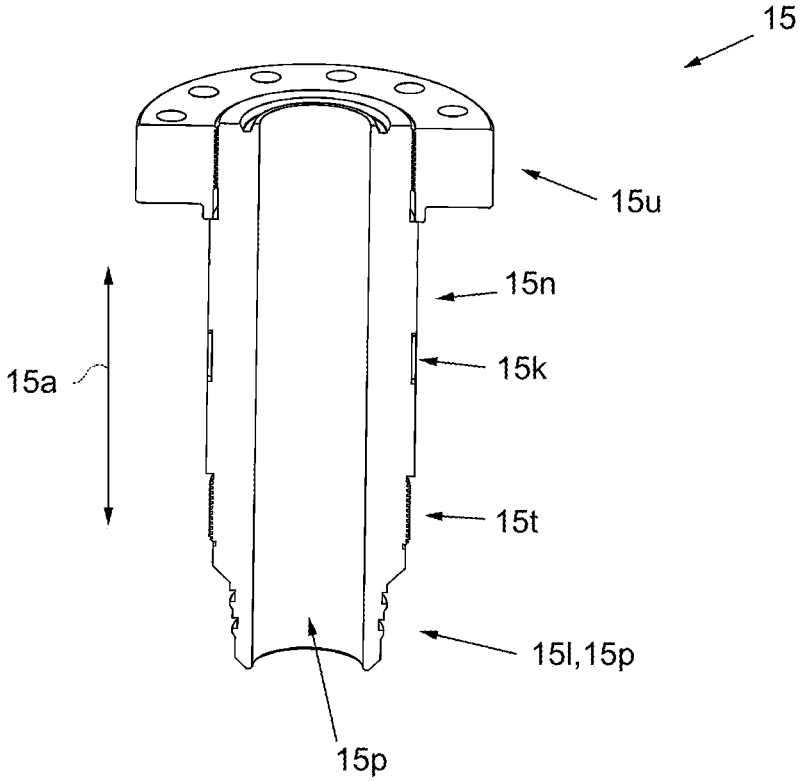
FIG. 7*b* is a sectioned view of the crossover of FIG. 7*a;*
Figure 7C:
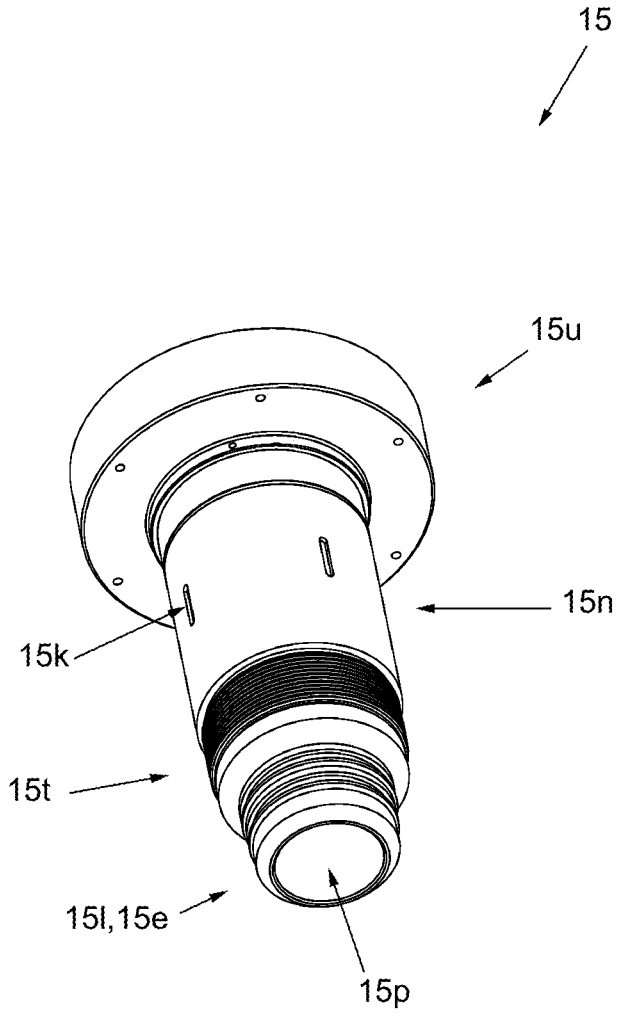
FIG. 7*c* is a bottom perspective view of the crossover of FIG. 7*a;*

The crossover 15 can be understood with reference to the embodiments shown in FIGS. 7*a*-7*c*. The crossover 15 is a hollow tubular member, having a crossover passage 15*p* therethrough, a longitudinal axis 15*a* and comprising a first, upper connection 15*u* for connecting to a PCE (not shown) or a nightcap (not shown) in a conventional manner. Preferably the upper connection 15*u* is a flanged connection. In an alternate embodiment upper connection 15*u* may be a threaded connection (not shown). When the wellhead connection 10 is in the threaded, connected state C, flange passage 12*p* and crossover passage 15*p* cooperate to form passage P.

The crossover 15 further comprises a second, lower connection 15*l* for connecting to the flange assembly 12. The lower connection 15*l* of the crossover 15 includes a pin end 15*e* configured to be received by, and sealably mate with, the receptacle 12*r* of the flange assembly 12 so that when energized and/or engaged said flange assembly 12 and crossover 15 form a sealed connection SC (see FIG. 10*b*). In operation, the pin end 15*e* of the crossover 15 is inserted into the receptacle 12*r* of the flange assembly 12. Preferably, the pin end 15*e* includes mechanisms (e.g., O-rings and/or seals S in grooves or glands) to create a circumferential seal SC between the pin end 15*e* and the receptable 12*r* of the flange assembly 12 for operation at predetermined conditions primarily based on wellhead pressure. The seal mechanism is pressure-dependent, different pressures require different seal designs or materials. The seal mechanisms may also vary depending on fluids in the wellbore or temperature at the wellhead. For example, a different material or cross-sectional shape of the O-ring may be required for sour gas or higher temperatures.

Preferably a sliding section 15*n* is provided between the upper connection 15*u* and the lower connection 15*l*, the sliding section 15*n* configured to slidably and rotatably support or carry the nut assembly 14. The nut assembly 14 can thereby slide or travel along the sliding section 15*n* (i.e. in a direction parallel to the longitudinal axis 15*a*) between an engaged position (wherein the nut assembly 14 is closer to the lower end 15*l*) and a disengaged position (wherein the nut assembly 14 is closer to the upper end 15*u*); see FIGS. 9*c* and 9*b* respectively. More preferably, the sliding section 15*n* is configured to slidably support or carry a anti-rotation member 40, as further described below (see FIGS. 8*a*-8*d*).

The crossover 15 preferably further comprises a threaded section 15*t* configured to threadably mount or connect a retaining ring 15*r*. The nut assembly 14 and anti-rotation member 40 are preferably captured and retained on the carrying section 15*n* by the upper flanged connection 15*u* and the retaining ring 15*r* (see FIG. 12*a*). During manufacturing and assembly of the wellhead connection 10, the nut assembly 14 and anti-rotation member 40 may be positioned over the lower connection 15*l* and slidably placed onto the sliding section 15*n*. Then retaining ring 15*r* is mounted on the threaded section 15*t*.

Nut assembly 14 has an inside passage or bore 14*p* of sufficient diameter to allow it to slide along sliding section 15, but not so large as to also slide over the upper flanged connection 15*u* and the retaining ring 15*r* (i.e. the upper flanged connection 15*u* and the retaining ring 15*r* have outside diameters and dimensions that are larger than the diameter of bore 14*p*). Similarly, anti-rotation member 40 has an inside passage or bore 40*p* of sufficient diameter to allow it to slide along sliding section 15, but not so large as to also slide over the upper flanged connection 15*u* and the retaining ring 15*r* (i.e. the upper flanged connection 15*u* and the retaining ring 15*r* have outside diameters and dimensions that are larger than the diameter of bore 40*p*).

Figure 10A:
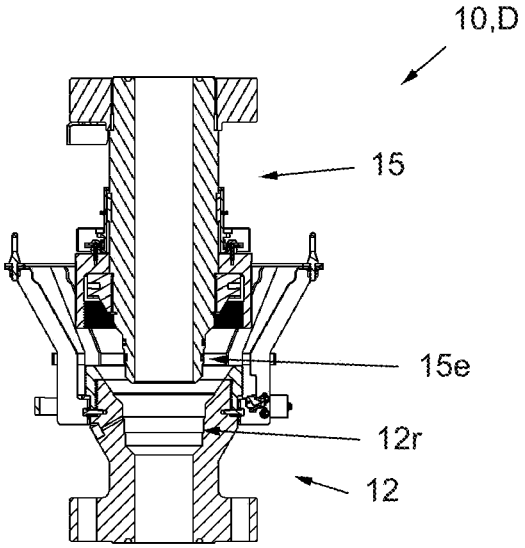
FIGS. 10*a*-10*b* are freeze-frame, sectioned views showing the remote actuated rotary wellhead connection of FIG. 1 moving between a disconnected state (FIG. 10*a*) and connected state (FIG. 10*b*)
Figure 10B:
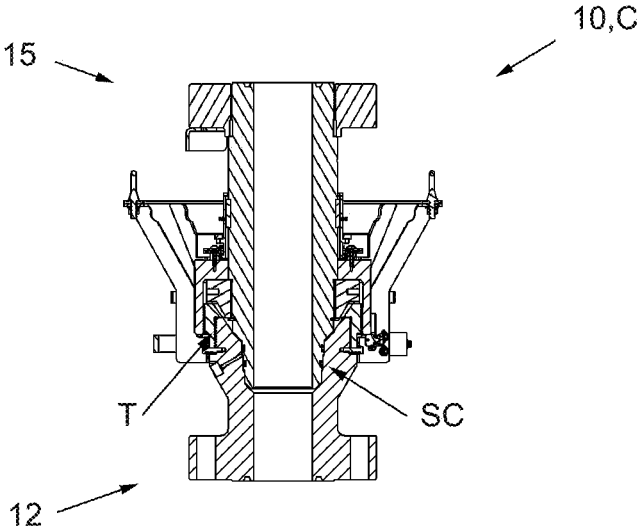

As will now be appreciated by those skilled in the art, the nut assembly 14 captured on the crossover 15 by retaining ring 15*r* can then be used in a conventional manner as a nut to threadably, sealably connect crossover 15 to flange assembly 12; i.e. the threaded section 14*t* on the nut assembly 14 will threadably, engage with, and mate to, threaded section 12*t* on the flange assembly 12 to create a threadable connection T and to maintain the pin end 15*e* within the receptacle 12*r* in the sealed connection SC (see FIG. 10*b*).

Preferably the threaded sections 12*t*, 14*t* on the flange assembly 12 and nut assembly 14 are acme double start thread; i.e. the threads having two starting points exactly 180 degrees opposite to each other. Advantageously this provides two points of contact, so nut assembly will be less likely to lean one way or the other about longitudinal axis 15*a* (as compared to a thread having only a single start). More advantageously, a double start thread will also assists with starting the threading of the nut assembly 14 onto the flange assembly 12.

Figure 11:
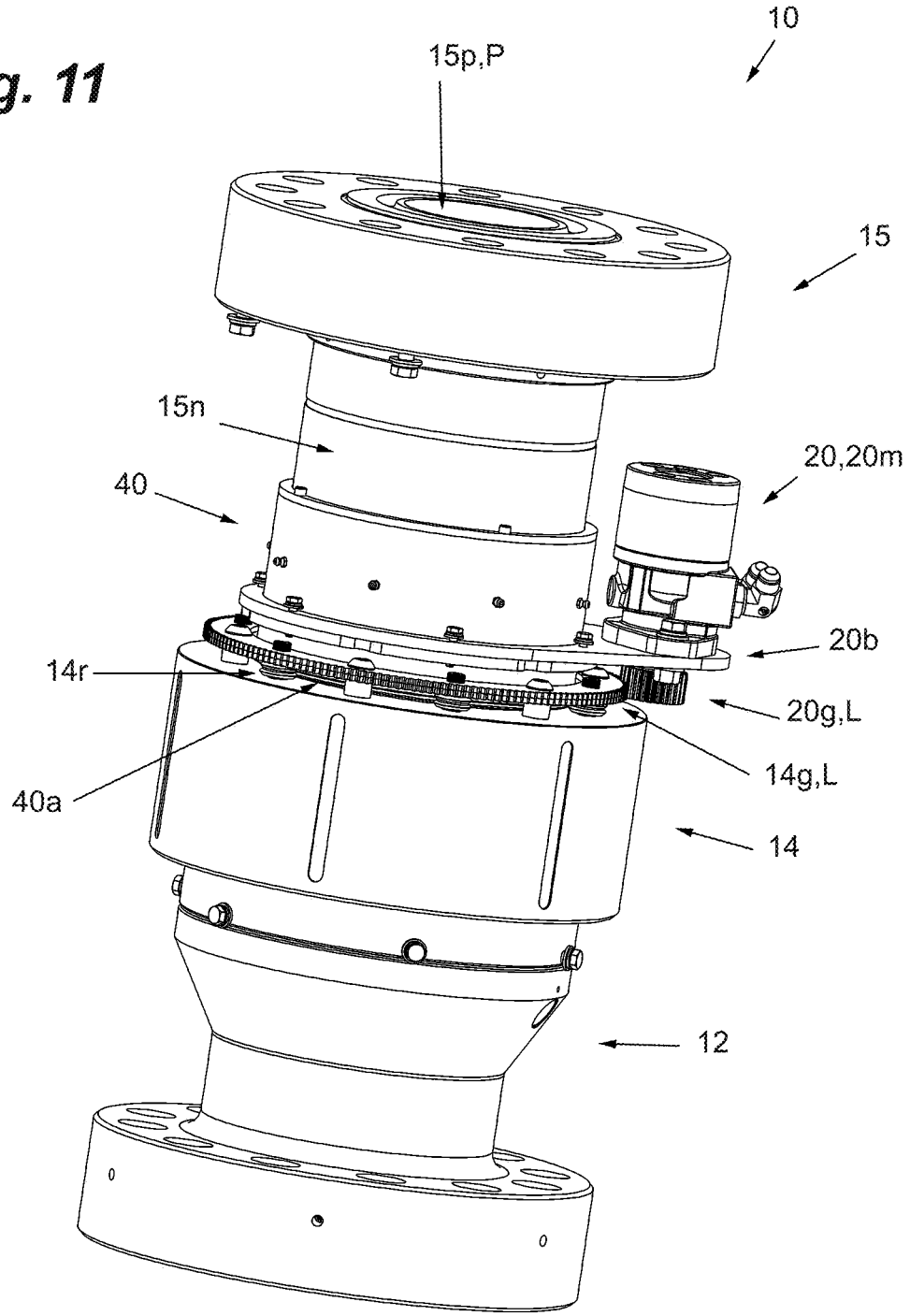
FIG. 11 is a perspective view showing the main components of the remote actuated rotary wellhead connection of FIG. 1, and with the other components hidden.
Figure 12A:
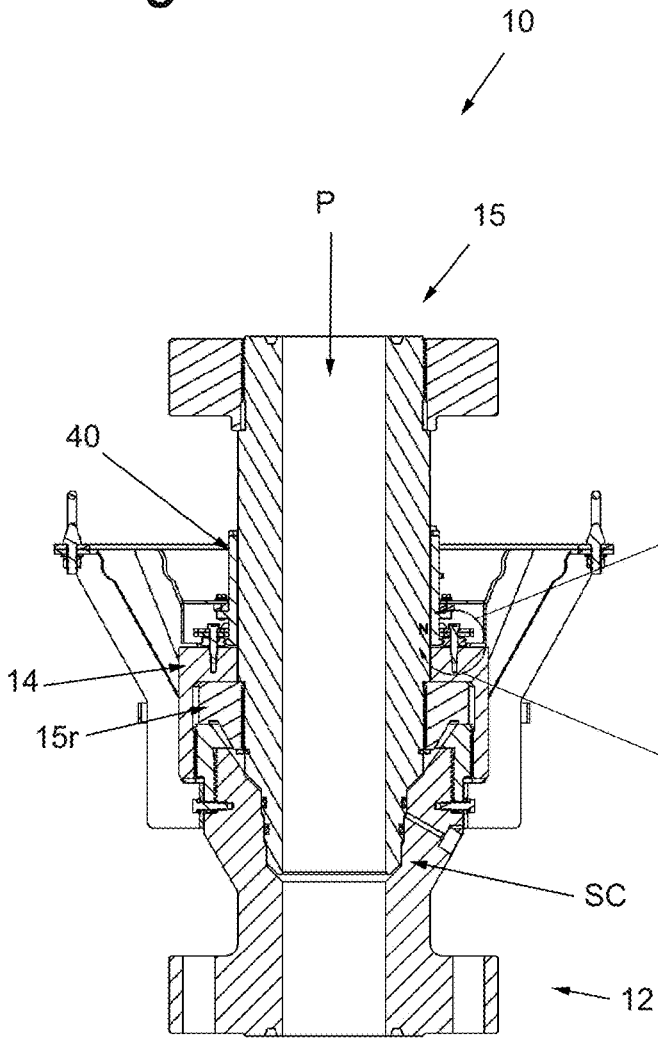
FIG. 12*a* is a sectioned view of the remote actuated rotary wellhead connection of FIG. 1 in a connected state.
Figure 12B:
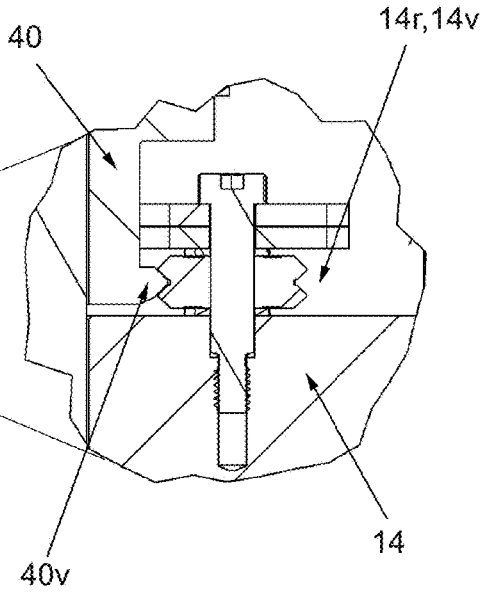
FIG. 12*b* is an enlarged view of a portion of FIG. 12*a*.

Preferably the nut assembly 14 and the anti-rotation member 40 are slidably linked as further described below (i.e. both the nut assembly 14 and anti-rotation member 40 will slidably move along sliding section 15 in unison), and can rotate relative to each other about the sliding section 15 and around the crossover's longitudinal axis 15*a*. Nut assembly actuator 20 is mounted on, and supported by, the anti-rotation member 40, as further described below and as can be seen in FIG. 11).

Figure 8A:
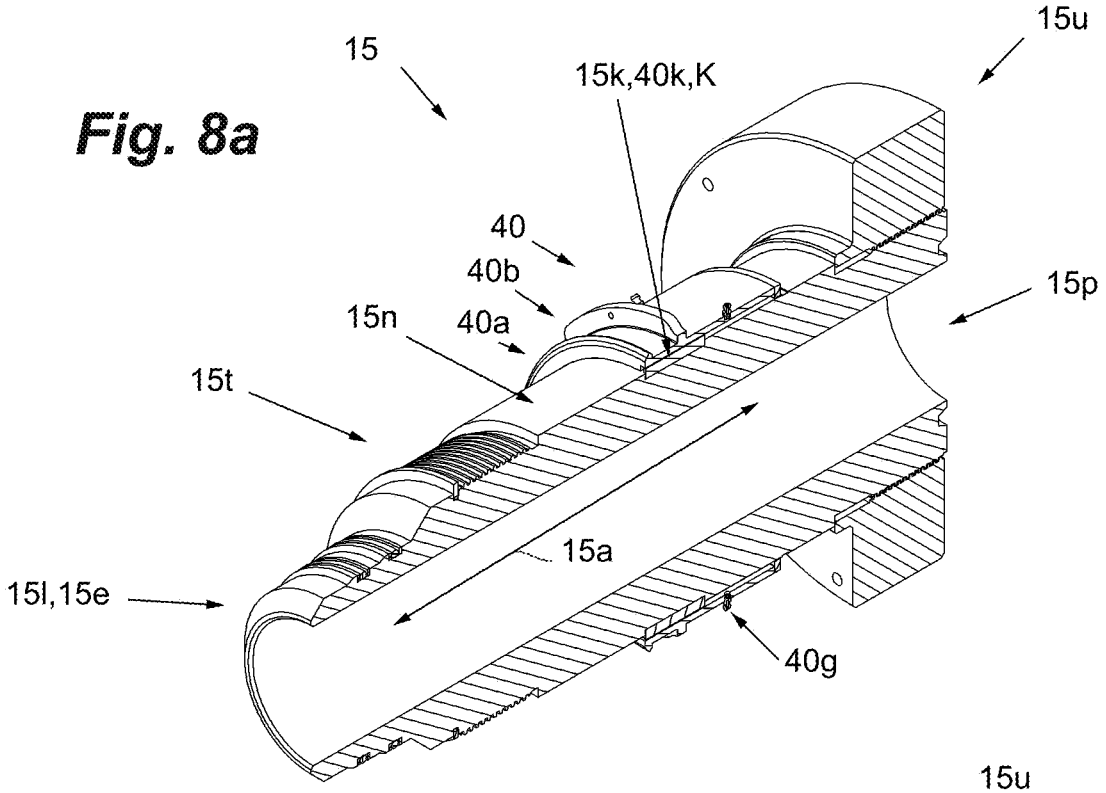
FIGS. 8*a*-8*b* are sectioned perspective views of an exemplary crossover of a wellhead connection according to an aspect of the invention, showing an anti-rotation member mounted thereon, with the anti-rotation member being closer to the upper connection in FIG. 8*a*, with the anti-rotation member being closer to the lower connection in FIG. 8*b;*
Figure 8B:
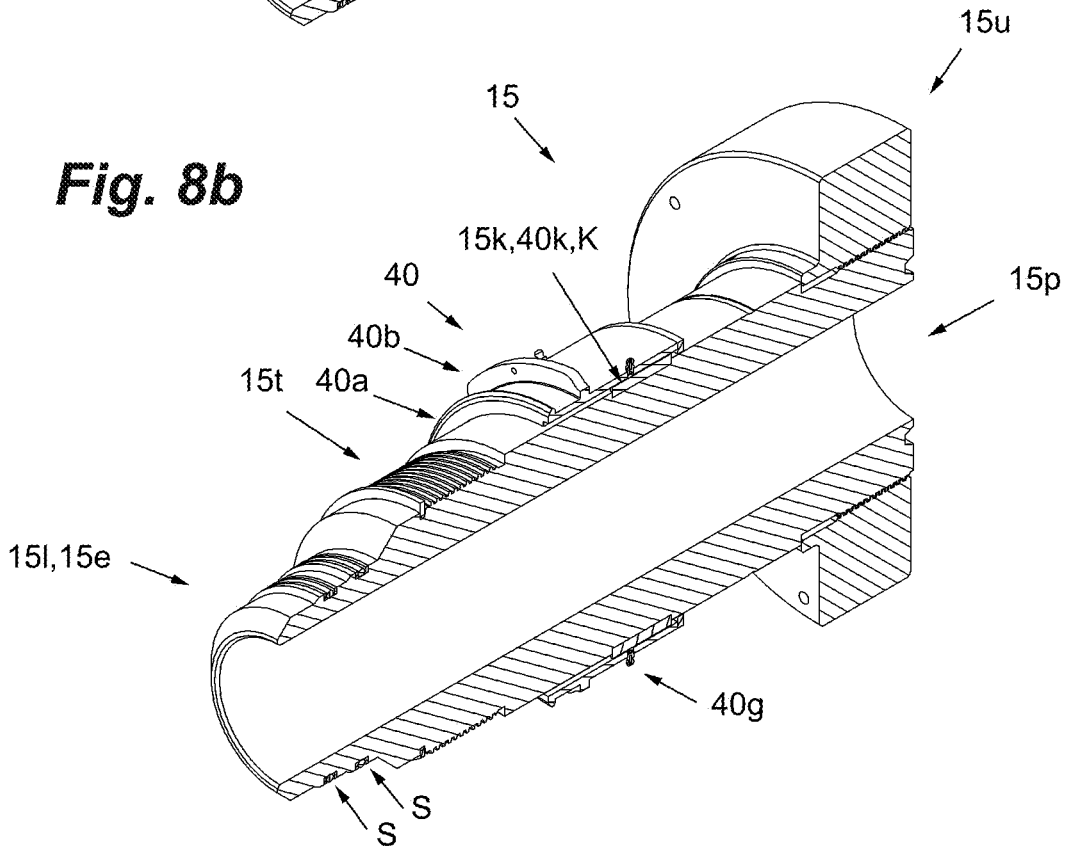

Preferably one or more sets of keys K, crossover keyways 15*k* and anti-rotation member keyways 40*k* are provided to slidable retain the anti-rotation member on the crossover 15; see FIGS. 8*a*-8*b*. Keys K and keyways 15*k*, 40*k* cooperate in a conventional manner to prevent anti-rotation member 40, and nut assembly actuator 20 mounted thereon, from rotating about longitudinal axis 15*a* of the crossover 15 and limit the movement of both the anti-rotation member 40 and nut assembly actuator 20 on the crossover 15 to only sliding movement between upper and lower connections 15*u*, 15*l* (i.e. keys K and keyways 40*k*, 15*k* act as an anti-rotation means). More preferably, one or more grease fittings 40*g* are provided to allow for an operator to insert grease and lubrication in the annular space between the crossover 15 and the anti-rotation member.

Figure 8C:
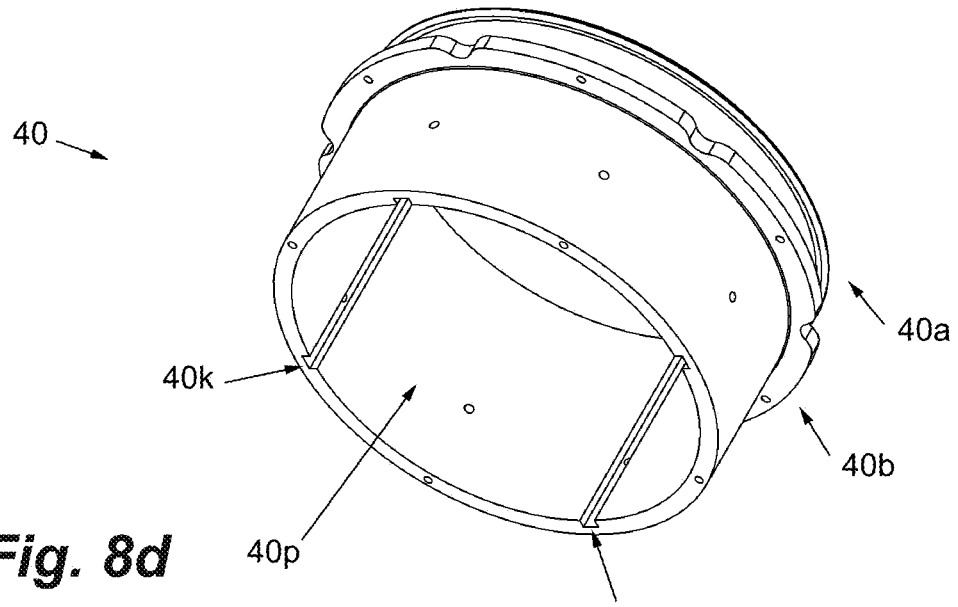
FIGS. 8*c*-8*d* are perspective views of an exemplary anti-rotation member of a wellhead connection according to an aspect of the invention.
Figure 8D:
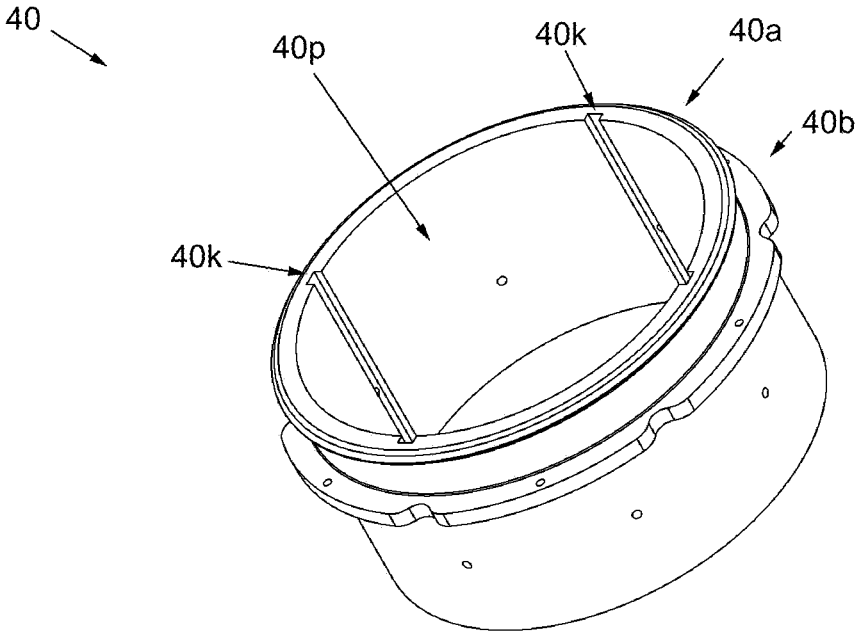
Figure 9A:
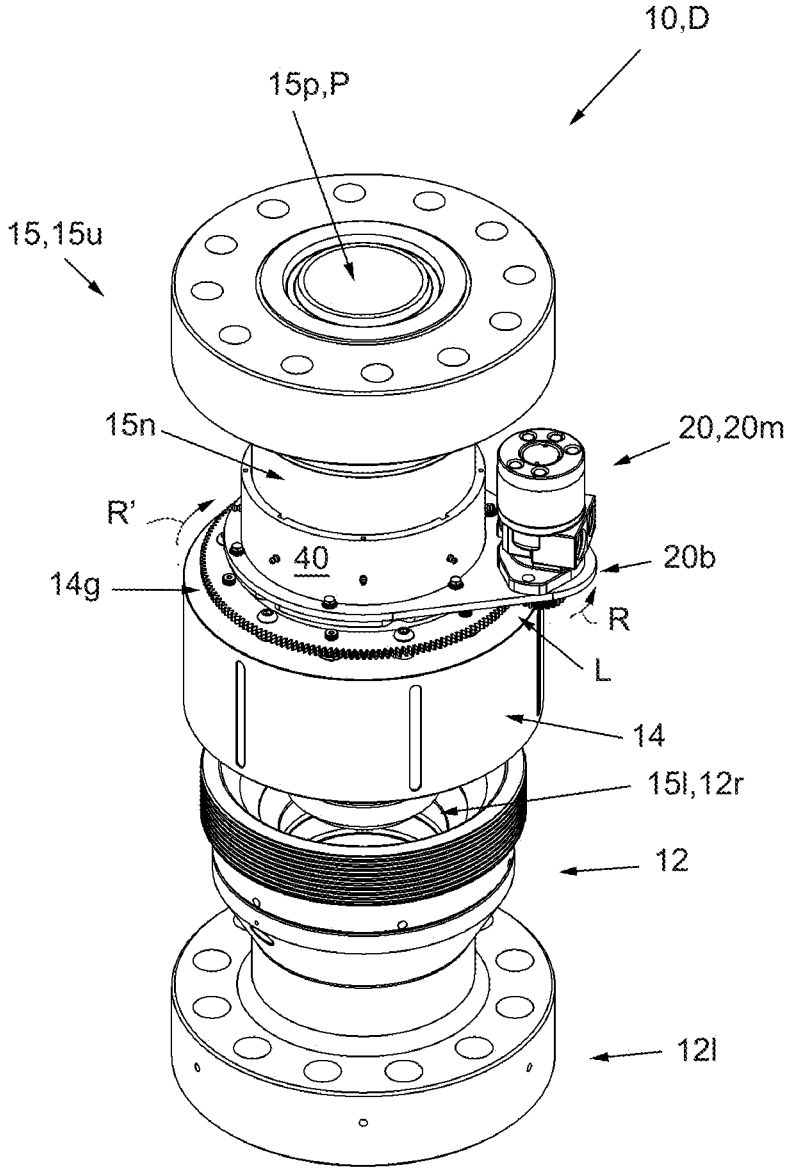
FIGS. 9*a*-9*c* are freeze-frame, side perspective views showing the main components of the remote actuated rotary wellhead connection of FIG. 1 moving between a disconnected state (FIG. 9*a*) and connected state (FIG. 9*c*)
Figure 9B:
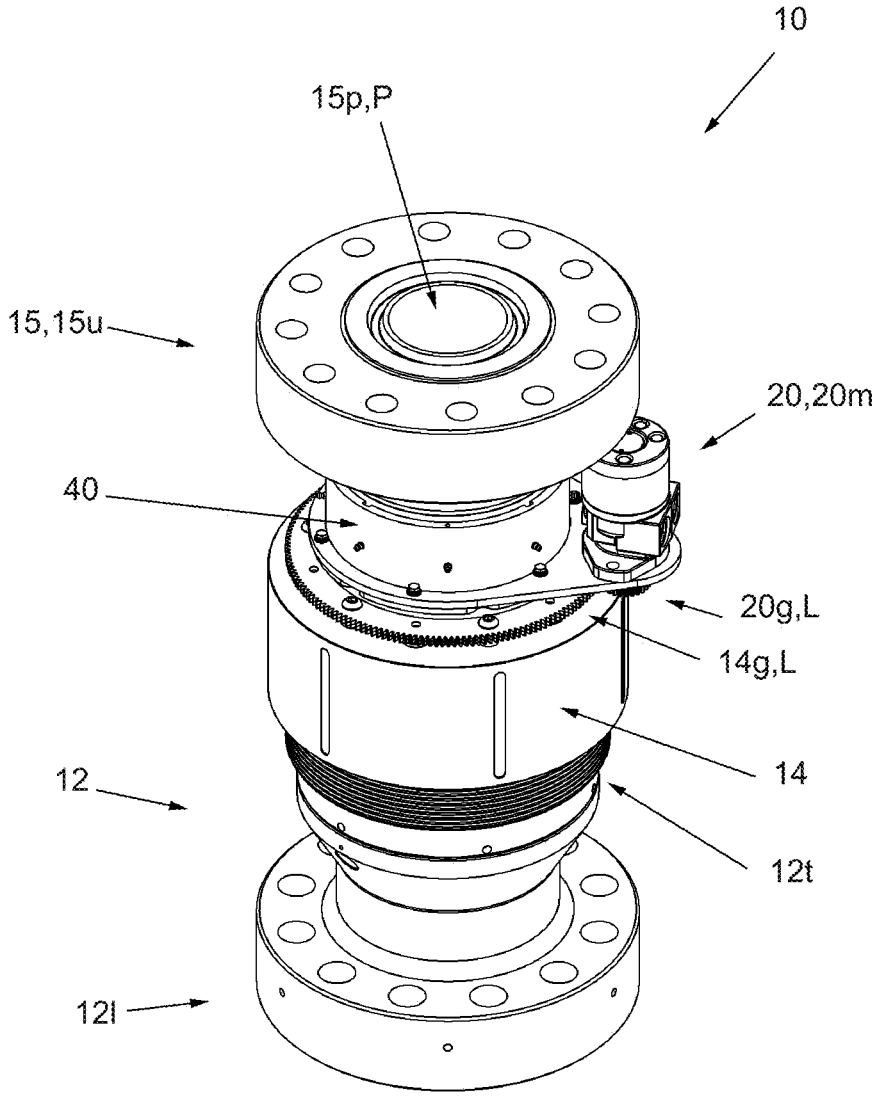
Figure 9C:
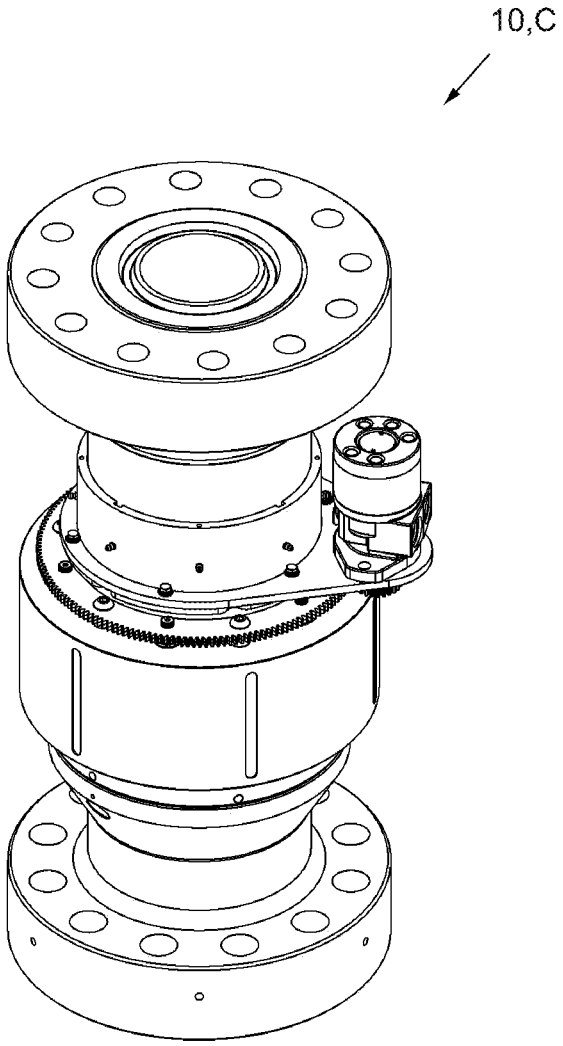

In a preferred embodiment, shown in more detail in FIGS. 8*c*-8*d*, the anti-rotation member 40 further comprises a first hub or circumferential external ridge 40*a* and a second hub or circumferential external ridge 40*b*. The first hub or ridge 40*a* is configured to mate with, and be captured by, one or more rollers 14*r* rotatably mounted on the nut assembly 14, thereby slidably linking the nut assembly 14 to the anti-rotation member 40 while allowing nut assembly 14 to still rotate relative to anti-rotation member 40 and the crossover 15 (see FIGS. 11, 12*a* and 12*b*). Preferably the one or more rollers 14*r* are v-groove rollers 14*v* and first hub 40*a* presents a cooperating v-shaped ridge profile 40*v*. The second hub or ridge 40*b* is configured to support and mount the nut assembly actuator 20 to the anti-rotation member 40. In a preferred embodiment, a mounting bracket 20*b* is provided between the second hub 40*b* and the nut assembly actuator 20 to facilitate mounting the nut assembly actuator to the anti-rotation member.

Preferably the nut assembly actuator 20 is a hydraulic motor having a first gear 20*g*. In alternate embodiments (not shown) the nut assembly actuator 20 may be an electrical motor having a first gear, or a pneumatic drive having a first gear. Remote actuation of the nut assembly actuator 20 is accomplished in a conventional manner; e.g. via electric wiring, a source of suitable electricity and electric controls if the actuator 20 is an electric motor, via hydraulic hoses, a source of suitable hydraulic fluid and hydraulic controls if the actuator 20 is a hydraulic motor, or via pneumatic hoses, a source of suitable compressed air and pneumatic controls if the actuator 20 is a pneumatic drive. More preferably a second, cooperating gear 14*g* is provided on the nut assembly 14. First and second gears 20*g*, 14*g* cooperate to provide a rotating linkage L and to rotatably link or couple the nut assembly actuator 20 to the nut assembly (see FIGS. 9*a* and 9*b*). As will now be appreciated by those skilled in the art, because nut assembly actuator 20 is mounted to the anti-rotation member 40, nut assembly actuator 20 itself cannot rotate relative to the crossover 15, i.e. nut assembly actuator 20 can only slide along the sliding section 15*n* via anti-rotation member 40. Nut assembly actuator 20, when actuated, can spin or rotate the first gear 20*g* (e.g. in direction R) and then, via rotating linkage L and second gear 14*g*, drive or spin the nut assembly 14 (e.g. in direction R'; see FIG. 9*a*). As will now also be appreciated by those skilled in the art, because nut assembly 14 is free to rotate about the crossover 15 and the sliding section 15*n*, nut assembly 14 will rotate when the nut assembly actuator 20 is actuated.

More preferably, the nut assembly actuator 20 can be actuated to rotate the first gear 20*g* in both a clockwise and anti-clockwise direction, e.g. by adjusting the direction of hydraulic fluid through hydraulic motor 20*m*. Even more preferably, hydraulic hoses, connections and controls (e.g. valves) are provided to allow an operator to remotely actuate the nut assembly actuator 20 in a conventional manner. Advantageously, an operator can remotely select the direction of rotation of the first gear 20*g* by controlling the direction of hydraulic fluid through hydraulic motor 20*m* and, hence, the direction of rotation of the nut assembly 14 and, thereby, drive the nut assembly 14 back and forth between the threaded, connected state C and the unthreaded, disconnected state as may be desired.

During operations on a wellsite having multiple wellheads (not shown), a plurality of flange assemblies 12 are preferably provided so that each individual wellhead has a flange assembly 12 connected to it. A single crossover 15, supporting a PCE, may be provided, remotely actuated between connected and disconnected states C,D, moved from one of the plurality of flange assemblies 12 to another 12 and then be remotely actuated between disconnected and connected states C,D as may be desired by a wellsite operate. The single crossover 15 may be moved between the plurality of flange assemblies 12 in a conventional manner, such as via chains and a crane in a conventional manner.

Although the disclosed high pressure seal embodiments have been described with reference to an exemplary application in pressure control at a wellhead, alternative applications could include, for example, areas such as deep core drilling, offshore drilling, methane drilling, open hole applications, hydraulic fracturing, wireline operations, coil tubing operations, mining operations, and various operations where connections are needed under a suspended or inaccessible load (i.e., underwater, hazardous area).

Unless otherwise specified, it is preferred that the components of the invention be made of suitable high-strength materials capable of taking stresses and strains during its intended use during well operations. Exemplary materials used in the construction of the disclosed wellhead connection embodiments include high strength alloy steels, high strength polymers, and various grades of elastomers and seals S.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The invention claimed is:

1. A remote actuated rotary wellhead connection system for connecting pressure control equipment to a wellhead, the system comprising:

a flange assembly (12) connectable to the wellhead;

a crossover (15) having a longitudinal axis (15*a*);

a nut assembly (14) to threadably secure the crossover (15) to the flange assembly 12; and a nut assembly actuator (20) to actuate the nut assembly (14) between a threaded, connected state and an unthreaded, disconnected state;

wherein the crossover (15) is connectable to the pressure control equipment; and wherein the nut assembly actuator (20) is remotely actuatable;

wherein the crossover further comprises a sliding section (15*n*) configured to slidably and rotatably carry the nut assembly (14) in a direction parallel to the longitudinal axis (15*a*) between an engaged position and a disengaged position.

2. The remote actuated rotary wellhead connection system of claim 1 wherein the nut assembly (14) is slidably, rotatably mounted on the crossover (15).

3. The remote actuated rotary wellhead connection system of claim 2 further comprising a guide (16) to assist in positioning the crossover (15) for subsequent securing to the flange assembly (12) via nut assembly (14).

4. The remote actuated rotary wellhead connection system of claim 3 wherein the guide (16) has one or more windows (16*w*).

5. The remote actuated rotary wellhead connection system of claim 2 wherein the flange assembly (12) is a hollow tubular member, having a flange passage (12*p*) therethrough and further comprises:

a first connection (121) for connecting to the wellhead; and a second connection (12*u*) for connecting to the crossover (15).

6. The remote actuated rotary wellhead connection system of claim 5 wherein the first connection (121) is a flanged connection;

wherein the second connection (12*u*) comprises a receptable (12*r*) configured to receive the crossover (15);

wherein the nut assembly (14) comprises a threaded section (14*t*); and wherein the second connection (12*u*) further comprises a threaded section (12*t*) configured to threadably engage with the threaded section (14*t*).

7. The remote actuated rotary wellhead connection system of claim 6 wherein the crossover (15) is a hollow tubular member having a crossover passage (15*p*), a first connection (15*u*) for connecting to the pressure control equipment, and a second connection (151) for connecting to the flange assembly (12).

8. The remote actuated rotary wellhead connection system of claim 7 wherein the first connection (151) of the crossover (15) comprises a pin end (15*e*) sealably receivable by the receptacle (12*r*) to form a sealed connection.

9. The remote actuated rotary wellhead connection system of claim 8 wherein the crossover (15) further comprises the sliding section (15*n*) is between the first connection (15*u*) and the second connection (15*l*).

10. The remote actuated rotary wellhead connection system of claim 9 further comprising an anti-rotation member (40) slidably supported by the sliding section (15*n*).

11. The remote actuated rotary wellhead connection system of claim 10 wherein the crossover (15) further comprises a threaded section (15*t*) configured to threadably mount a retaining ring (15*r*).

12. The remote actuated rotary wellhead connection system of claim 11 wherein the first connection (15*u*) is a flanged connection; and wherein the nut assembly (14) and the anti-rotation member (40) are slidably captured on the carrying section (15*n*) between the flanged connection (15*u*) and the retaining ring (15*r*).

13. The remote actuated rotary wellhead connection system of claim 12 wherein the nut assembly (14) and the anti-rotation member (40) are slidably linked, can rotate relative to each other about the sliding section (15*n*) and can rotate around the longitudinal axis (15*a*).

14. The remote actuated rotary wellhead connection system of claim 13 wherein the nut assembly actuator (20) is mounted on, and supported by, the anti-rotation member (40).

15. The remote actuated rotary wellhead connection system of claim 14 further comprising:

at least one key (K);

at least one crossover keyway (15*k*); and at least one anti-rotation member keyway (40*k*);

wherein said at least one key (K), said at least one crossover keyway (15*k*) and said at least one anti-rotation member keyway (40K) cooperate to slidably retain the anti-rotation member (40) on the sliding section (15*n*).

16. The remote actuated rotary wellhead connection system of claim 10 further comprising at least one roller (14*r*) rotatably mounted on the nut assembly 14;

wherein the anti-rotation member (40) further comprises a first hub (40*a*);

wherein the first hub (40*a*) is captured by the at least one roller (14*r*) to slidably link the nut assembly (14) to the anti-rotation member (40) while allowing nut assembly (14) to rotate relative to anti-rotation member (40) and the crossover (15).

17. The remote actuated rotary wellhead connection system of claim 16 wherein the anti-rotation member (40) further comprises a second hub (40*b*); and wherein the second hub (40*b*) is configured to mount the nut assembly actuator (20) to the anti-rotation member (40).

18. The remote actuated rotary wellhead connection system of claim 1 wherein the nut assembly actuator (20) is a hydraulic motor.

19. The remote actuated rotary wellhead connection system of claim 18 wherein the nut assembly actuator (20) is a hydraulic motor having a first gear (20*g*);

wherein the nut assembly (14) further comprises a second gear (14*g*); and wherein the first gear (20*g*) and the second gear (14*g*) cooperate to rotatably link the nut assembly actuator (20) to the nut assembly (14).

20. The remote actuated rotary wellhead connection system of claim 1 wherein the nut assembly actuator (20) is selected from group consisting of a hydraulic motor, an electric motor and a pneumatic motor.

* * * * *